US005186699A

United States Patent [19]

Dimmig

[11] Patent Number: 5,186,699

[45] Date of Patent: Feb. 16, 1993

[54] FUNCTIONAL EXERCISE ATTACHMENT TRAINER FOR SWUNG ATHLETIC IMPLEMENTS

[76] Inventor: D. Avery Dimmig, P.O. Box 61, East Aurora, N.Y. 14052

[21] Appl. No.: 790,165

[22] Filed: Nov. 12, 1991

[51] Int. Cl.[5] ..... A63B 21/00

[52] U.S. Cl. ..... 482/111; 273/26 R; 273/26 B; 273/29 A; 273/73 R; 273/77 R

[58] Field of Search ..... 482/111; 273/26 B, 29 A, 273/73 R, 186 C, 186 A, 26 R, 72 R, 77 R, 74

[56] References Cited

U.S. PATENT DOCUMENTS

| | | | |
|---|---|---|---|
| 3,604,706 | 9/1971 | Baukney | 273/74 |
| 3,809,397 | 5/1974 | Gruenewald | 273/26 B |
| 3,820,785 | 6/1974 | Occipinti et al. | 273/29 A |
| 3,931,967 | 1/1976 | Lyons et al. | 273/74 |
| 4,052,062 | 10/1977 | Casavant | 273/74 |
| 4,183,526 | 1/1980 | Brown | 273/29 A |
| 4,330,121 | 5/1982 | McCafferty | 273/186 C |
| 4,416,451 | 11/1983 | Solloway | 482/111 |
| 4,603,854 | 8/1986 | Krausz | 482/111 |
| 4,671,510 | 6/1987 | Schoenwetter | 273/29 A |
| 4,907,800 | 3/1990 | Passamaneck | 482/111 |
| 5,100,148 | 3/1992 | Smith | 273/186 A |

*Primary Examiner*—Richard J. Apley
*Assistant Examiner*—Lynne A. Reichard

[57] ABSTRACT

A light weight plastic "pan-like" device is attached to any sports swung implement. When attached, the implement is swung in any of the normal stroking motions. The device produces air resistance against the intended motion. With regular, repetitive exercise the arm, shoulder, and back muscles are strengthened. Functional exercise is achieved aerodynamic drag. The devices may be adjustable for a greater or lesser amount of resistance. The devices are quickly locked into place with a simple attachment means. The devices maximize the resistance per unit surface by minimizing weight and optimizing the air capturing features.

13 Claims, 4 Drawing Sheets

FUNCTIONAL EXERCISE ATTACHMENT TRAINER FOR SWUNG ATHLETIC IMPLEMENTS

BACKGROUND OF THE INVENTION

A. Field of the Invention

In general, the present invention is used for physical fitness and muscular development. The present invention is a training device for strengthening the arm, shoulder, and back muscles of athletes in sports utilizing player swung implements (i.e. rackets, bats, clubs, sticks, etc.). It utilizes aerodynamic drag principles to produce resistance against the motion of the stroke. The present invention is a light weight attachment to standard swung implements in the aforementioned sports. Although the physical dimensions of the present invention will vary based on the particular sports application, they utilize the same novel features to be enumerated in below. Presently on file with Patent and Trade Office is a Disclosure Document #264714, a copy of such enclosed, stating the date of invention as Mar. 23, 1990.

The ideal form of exercise is called "functional exercise" by Physical Therapists. Basically, functional exercise is exercise where specific muscle groups used by the stroking motion of a particular sport are taxed greater than normal. The opposing forces must be evenly distributed relative to the entire stroking motion (i.e. from the ready position to the backswing through to the follow-thru) and must not alter said motion. Numerous prior art utilize the principles of aerodynamic drag for exercise. However, each of these is missing one or more features that makes the present art unique.

B. Prior Art

The most common exercise of arm, shoulder, and back muscles include weight room training and weighted accessories to sports implements. Physical Therapists offer special exercises for rehabilitation of injured arms and shoulders usually involving coiled springs or elastic ropes. Also available are computerized iso-kinetic machines which offer variable resistance for a given force yielding a consistent speed. none of these replicate the actual stroking motion and are therefore not considered pure functional exercise.

The present invention was created from a desire to produce an exercise trainer for use at home during the off-season. The first sport addressed was tennis. Initially, a tennis racket was swung in a repetitive sequence with the "racket cover" on. The air resistance was noticed to provide significant drag. Next, cardboard models were designed with larger diameter "plane-like" surfaces. These were attached to the racket. The cardboard was lighter than the racket cover and the air resistance was greater. However, a large flat surface when stroked produced vibration in the implement's handle because the air slipped passed the outer edges unevenly. The racket stroke was misdirected by the unequal air pressure. Also, the large surface area, which was required to produce adequate resistance, became too cumbersome to manipulate.

The next model utilized a thin gauge plastic sheet. It was formed into a "pan-like" device which had a 16 inch diameter flat surface with a 3 inch high wall (or depth) around the perimeter. The wall provided the needed stability and eliminated the vibration in the handle. It trapped the air in front of the device during the stroking motion. This creates a greater air turbulence (or partial vacuum) behind the device increasing the drag. Ribs were added to strengthen the wall and to stiffen the body surface. The combination of the ribs and wall formed air pockets. The air pockets increased the resistance per unit of surface area because the air could not easily escape. Optimization of drag forces are achieved when the largest amount of air is captured and the greatest partial vacuum is generated per unit of surface area. Since most stroking motions form a large arc, it was found that a higher wall section along the most distant radial edge assisted in increasing drag.

The present art weighs less than 8 ounces due to the thin gauge material and maximized drag per unit surface area. Testing revealed that devices which add more than 8 ounces to the weight of the implement generated momentum forces that oppose (i.e. neutralize) the drag forces. The net effect of excessive momentum is to reduce drag. Also, gravitational forces created by excessive weight made the implement feel too heavy. Both the momentum and gravitational forces tended to distort the pure functional exercise. They caused an imbalance in the distribution of forces throughout the stroke.

In a few particular sports (i.e. golf and baseball), it was discovered that the shaft of the implement rotated along the its axis as much as 180 degrees while it was being swung. The rotation of the implement is typically caused by the wrists and hands working together to swing the implement. A device that is firmly locked to the implement will rotate along with the implement causing the angle of attack to become less than 90 degrees. The angle of attack should remain at 90 degrees throughout the entire stroking motion. The greatest resistance is achieved when a device remains perpendicular to the angle of attack during the stroke while the shaft of the implement rotates on its axis.

Therefore a device must provide for a means to rotate in the opposite direction of the shaft rotation. This counter rotation is accomplished by the present invention. The present invention balances the aerodynamic forces on both sides of the implement shaft during the backswing as well as the forward swing. The backside surface was so designed as to facilitate the balanced deflection of drag forces. The design features include rounded edges and angular ribs.

In addition, to facilitate the counter rotation, the present invention was developed to have a friction rotation attachment means. This means secured the implement to the device while at the same time allowed the device to rotate on the shaft of the implement as the drag forces dictated. Thus, the present invention remained perpendicular to the aerodynamic forces as the shaft of the implement rotated on its axis throughout the stroke. The above mentioned principles were successfully applied to numerous sports swung implements thus creating the present art.

Among the heretofore proposed devices or accessories of the character just described are those disclosed in U.S. Pat. Nos. 3,820,785 issued Jun. 28, 1974, to Occhipinti; 3,809,397 issued May 7, 1974, to Gruenewald; 4,603,854 issued Aug. 5, 1986, to Krausz; 4,183,526 issued Jan. 15, 1980, to Brown; 4,330,121 issued May 18, 1982, to McCafferty; 4,907,800 issued Mar. 13, 1990 to Passamaneck. Each of these patents is designed to generate aerodynamic drag and thereby promotes muscular development and coordination. The prior art uses principles of aerodynamics. However, none of the prior art accomplishes all of the following objectives:

(1) maximizes the drag forces per square unit surfaces area
(2) provides stability and eliminates vibration while stroking
(3) compensates for implement rotation during stroke by utilizing counter rotation attachment means
(4) minimizes weight generated inertial and gravitational forces
(5) an attachment means such that actual implements may be used The prior art with large flat plane-like designs tend to allow air to escape over the edges. This reduces drag and creates instability. The instability causes vibration and misdirection of the stroke. These designs have been proven to have the least co-efficient of drag resistance.

McCafferty and Gruenewald address the problem where some sports implements rotate along their axis during a stroke. McCafferty uses the concept he calls "aerodynamic neutrality". His invention, being spherical, maintains the same drag independent of its rotation by the implement. The nature of the sphere, however, does not optimize aerodynamic drag.

Gruenewald's vanes are 90 degrees apart along the shaft. As the implement rotates, the air hits the vanes at various angles and escapes. This reduces drag and the implement is deflected by the pressure imbalances. Most prior art do not account for implement rotation and therefore, tend to rotate such that the angle of attack is less than 90 degrees.

Research of the market place has disclosed one device that uses aerodynamic principles for the sport of tennis. A patent is pending as of this writing on his device called "Resist Air", by inventor Hohn Mueller. His invention is believed to be substantially different from the present invention. First, the "Resist Air" is not an implement attachment but a self-contained device with its own handle. Second, it is cumbersome to use. Imagine an extra large ping pong paddle. The molded handle is attached to ½ inch PVC tubing. The tubing loops in a 26 inch diameter circle and attaches to the handle. Stretched over the tubing is a dacron fabric which provides the flat surface area. Finally, the "Resist Air" creates an unstable swing. There is vibration in the handle. Both the backward and forward swinging motion is often misdirected because the air escapes around the edges.

SUMMARY OF THE INVENTION

The principle objective of the present invention is to provide a device for strengthening the arm, shoulder, and back muscles while performing normal sports strokes. Another objective of the present invention is to provide an inexpensive device that is easily attached to any size implement. This allows the sports player to use his (her) own implement while performing these exercises.

It is also an objective to provide a light weight device that does not negatively influence the mechanics of the stroke during an exercise routine. This is called "functional exercise" and is considered to be an ideal form of exercise.

It is an objective to provide a means by which the device rotates on the shaft of the certain sports implement so as to maintain its perpendicular position relative to the angle of attack during the entire swinging motion.

A final objective is to provide a device that, when attached to an implement, will produce a stable, smooth stroke while maximizing air resistance.

All of the above objectives can be accomplished by present art. Specific dimensions of the present invention for each sports application will vary, since each sports swung implement has unique requirements. Independent of the sports application, the present invention will contain all of the following design features:

(1) a large pan-like surface area or body in which the forward stroke captures the maximum amount of air and inturn creating a large vacuum or turbulence while maintaining its perpendicularity to the on rushing air.
(2) the backside designed to deflects air evenly on the backswing.
(3) a plurality of walls, ribs, and air pockets which enhance the co-efficient of drag.
(4) optimization of drag forces while minimizing the negative forces of too much weight.
(5) an attachment means.

DETAILED DESCRIPTION

Figure 1:
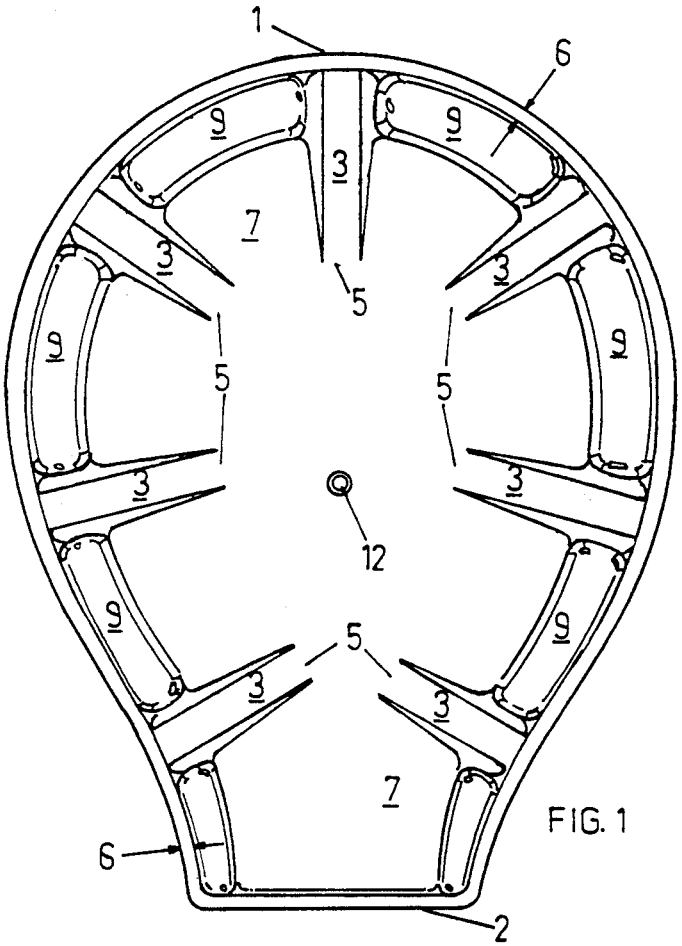
FIG. 1—a front view of the present invention's air catching surface as designed for the sport of tennis.
Figure 2:
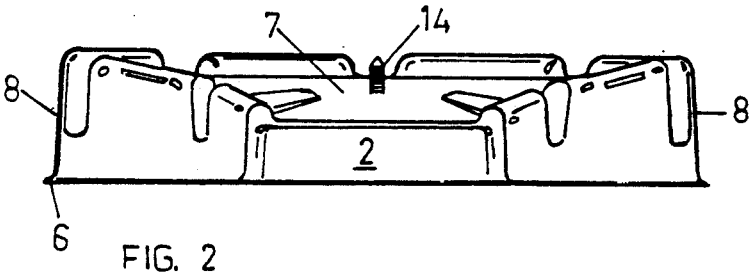
FIG. 2 —an end view of the neck area.
Figure 3:
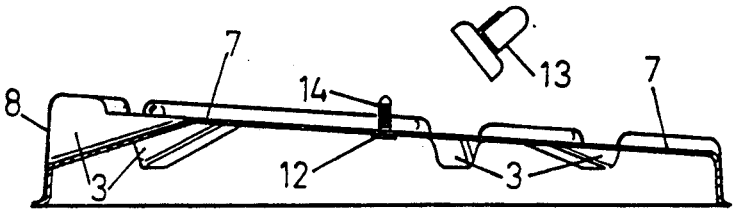
FIG. 3—a cut-away side view of the wall, the racket housing recess and the special plug and clip assembly.

As shown in FIGS. 1, 2, and 3 the preferred Functional Exercise Attachment Trainer in accordance with the present invention for tennis includes a head section 1 and a neck section 2 forming the main body. The head section 1 and neck section 2 exceed the surface area of the implement to obtain the desired amount of air resistance. The number of square inches of surface area is directly proportional to the particular sports requirements and the targeted player (i.e. adult vs. child, professional vs. amateur, etc.).

Figure 4:
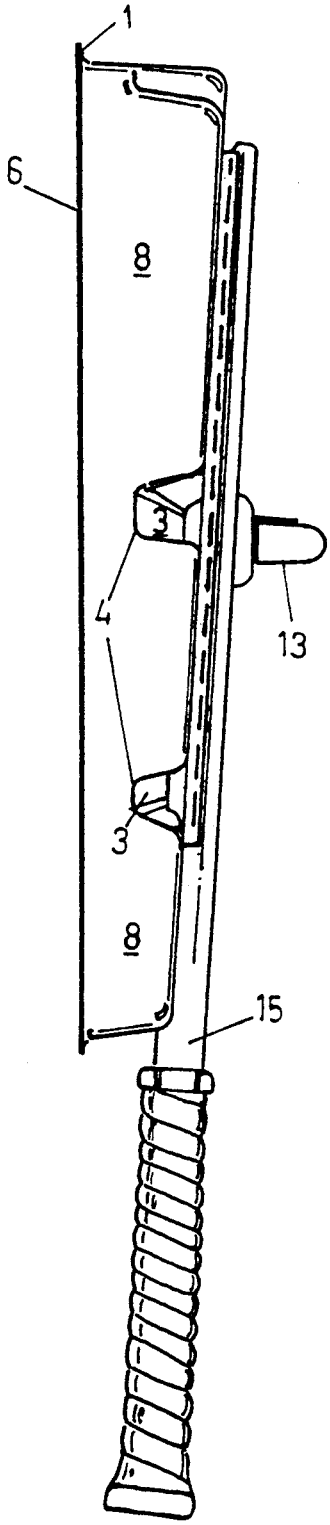
FIG. 4—a side view of the present invention with the implement attached using the plug and clip assembly.

The main body is preferably formed from a thin sheet of polymer resin and consists of the housing recess 7 and a series of air pockets 9. The housing recess 7 is designed to position the implement on the device. It has a depth of approximately ½ inch in the shape and size of the implement as shown in FIG. 3. FIG. 4 depicts the implement 15 placed onto the housing recess 7 with the bottom side up. The housing recess 7 is designed to accept any size implement. In addition, the housing recess 7 is elongated to allow the device to be attached high or low on the implement 15. This adjustment will increase or decrease the drag, respectively, for the same number of squares of surface area.

FIGS. 2, 3, and 4 depict the wall 8. It surrounds the perimeter of the device. It varies in height from the least at the neck section 2 to the greatest at the tip of the head section 1. The wall 8 increases in height at the most distant radial end of the device to compensate for the faster air speed. Normally the range in wall 8 height is from 1" to 4". The wall 8 together with the flat surface area forms a pan-like device. They work together to capture the air and push it forward. Less air can escape over the wall 8 thus creating greater partial vacuum behind. This generates more drag per square inch of flat surface area. The wall 8 provides stability for the device when in service. A similar device without a surrounding wall 8, when placed into service, allows air to escape over the edges creating imbalanced air pressure. This imbalance causes vibration and the intended direction of the stroke is altered. The wall 8 is slightly angled for the purpose of stacking devices for shipping. A rim 6 surrounds the top edge of the wall 8 to provide rigidity and to prevent the wall 8 from cracking.

Figure 5:
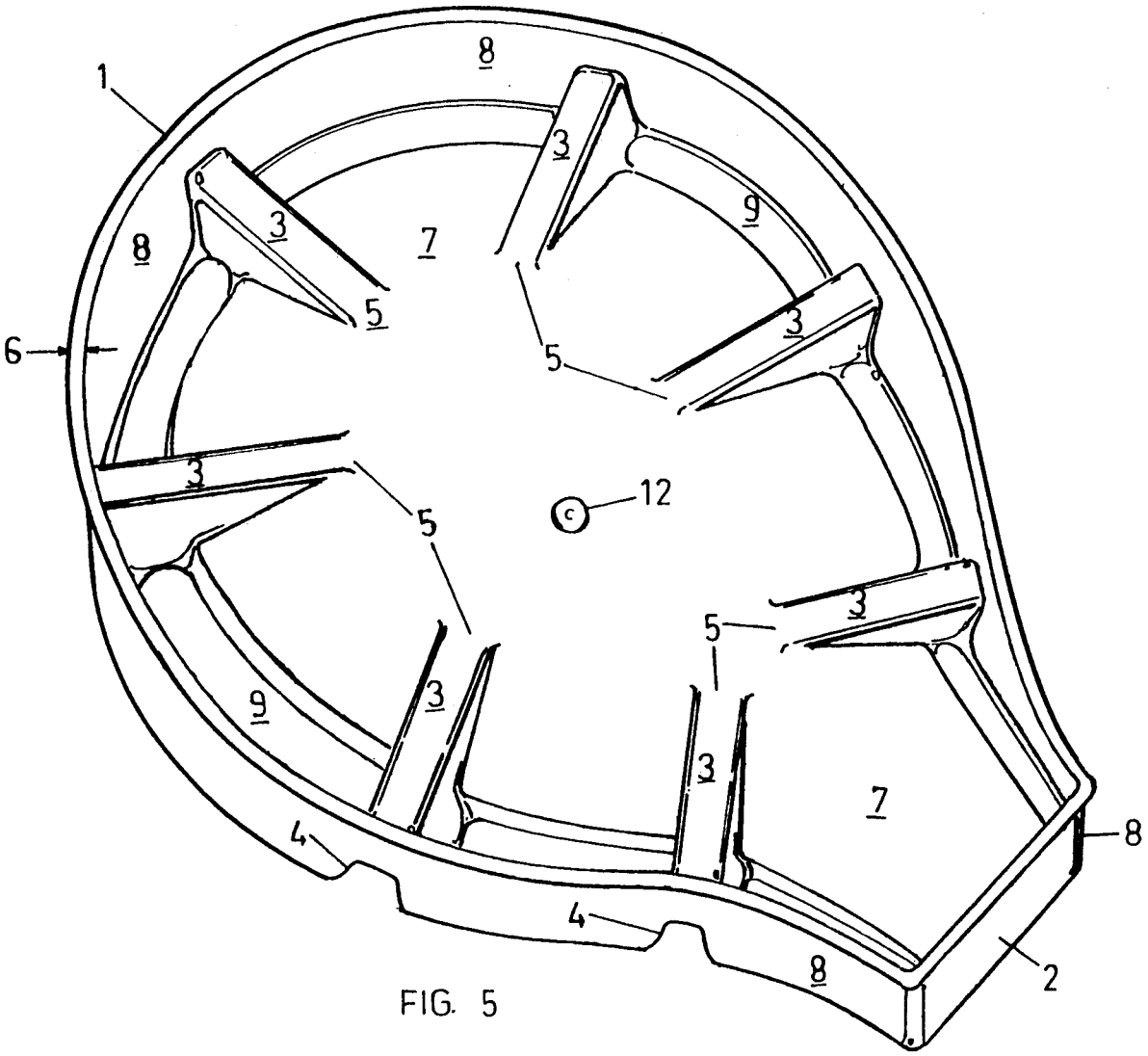
FIG. 5—a front view of the device from a three dimensional perspective depicting the air pockets.
Figure 6:
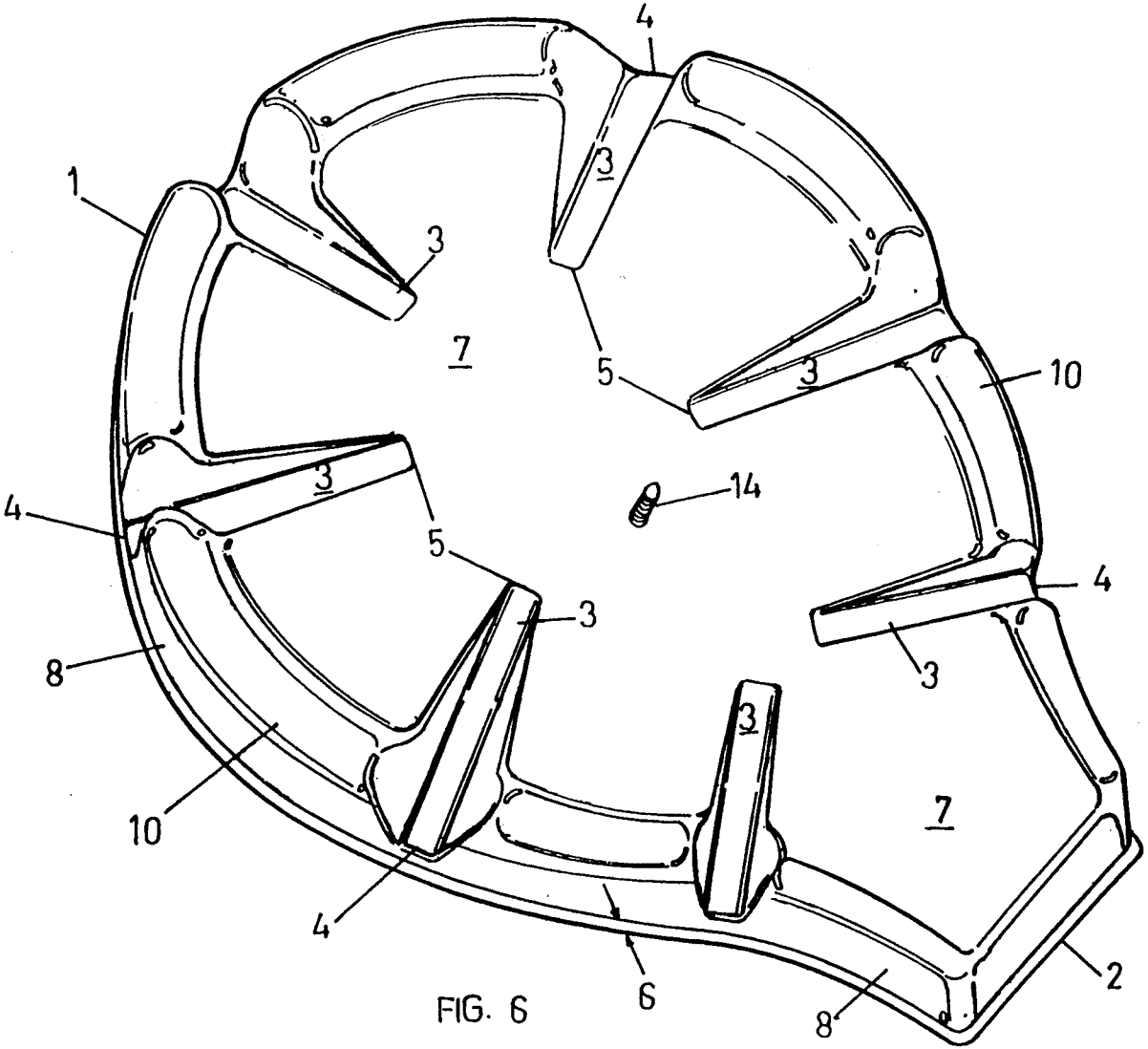
FIG. 6—the back view of the device from a three dimensional perspective featuring the air deflection designs.
Figure 9:
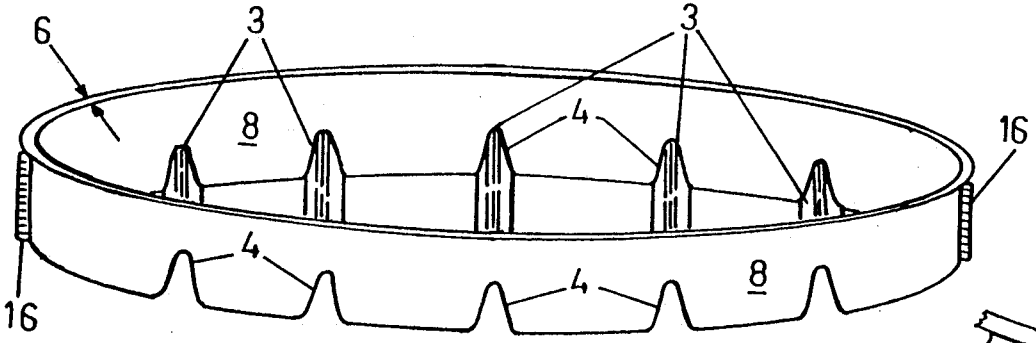
FIG. 9—the three dimensional view of the walls and rib structure.
Figure 7:
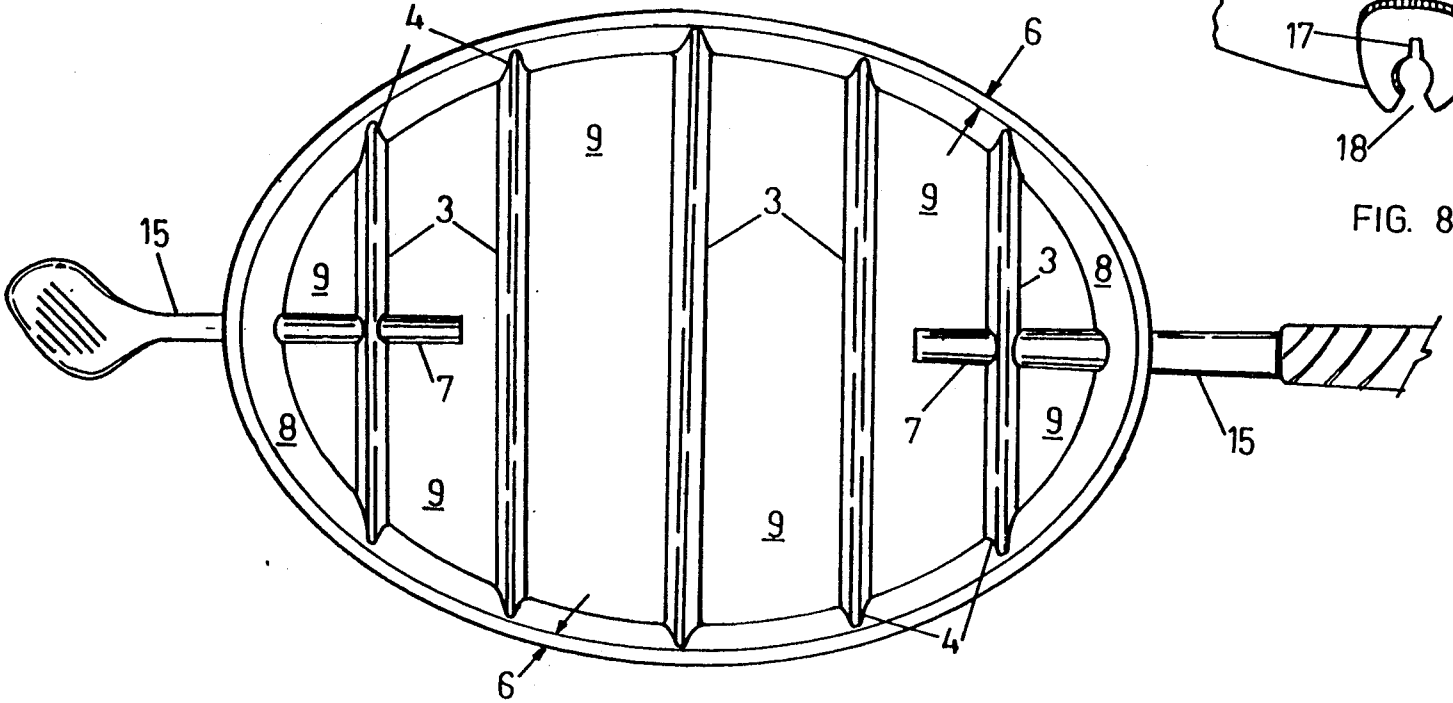
FIG. 7—the front view of the air catching surface as designed for golf.

The device incorporates a plurality of ribs 3 of varying sizes, styles, and functions. The ribs 3 strengthen the wall 8 and the housing recess 7 surfaces. They also function to constrict air movement similar to the function of the wall 8. The FIGS. 5 and 6 show the ribs 3 of a sloping, angular nature. These ribs 3 begin at position 4 near the top of the wall 8 and slope toward the center area 5 of the housing recess 7. In FIGS. 7 and 9, ribs 3 are level in nature across the full length of the housing recess 7 linking one wall 8 to the opposite wall 8. The ribs 3 may be parallel to each other and or perpendicular and or any angular pattern.

The combination of the wall 8, any two adjacent ribs 3, and the implement housing 7 form a means of creating air pockets 9. The air pockets 9 are designed to trap the air as the device is swung. The greatest drag is achieved by maximizing the trapped air raising the effects turbulence. Wind tunnel test have proven the present invention to have a greater co-efficient of drag than the same size flat surface. This feature further increases the amount of drag per square inch of surface area.

FIG. 6 depicts the backside of the device. The aerodynamic design of the backside of the device comes into play on the backswing. Generally, it is desired to minimize the drag forces during this phase of a swing. The air must deflect off this surface for a smooth backswing. This objective is accomplished by rounding the radii of the corners 10 at the base of the wall 8 and by the sloping, angular design of the ribs 3. Where implements rotate along the shaft, the counter rotation of the device is accomplished because of the air deflection. The deflected air creates pressure on either side of the shaft keeping it perpendicular to the angle of attack. These counter balancing drag forces are generated by the even deflection of the air a long the angular ribs 3.

The means used to attach the device to the implement is unique for each sport's application. It must be designed to the specific dimensional and functional requirements of that implement. Two varieties have been developed.

The first is attachment means is of the fixed locking type. FIG. 3 depicts the plug 12 and clip 13 assembly. The unique design for tennis requires that the device be positioned and locked into place. The plug 12 and clip 13 assembly are constructed from light weight, sturdy plastic. The plug head is attached to the housing recess 7 with an industrial non-toxic adhesive. To assemble the present invention, the racket is placed into the housing recess 7 from the bottom side, The plug stem 14 goes through the strings of the tennis racket. The device is pressed against the strings as the clip 13 is aligned and released onto the plug 12. The plug stem 14 has a series of barbs that allow for variable racket body widths. The large surface area of the clip 13 distributes the tension across the racket strings. Numerous styles of attachment assemblies were tried. The plug and clip was the fastest, simplest, most reliable, and cost effective method for attaching the device to a racket. FIG. 4 shows an assembled implement 15 of tennis with the clip 13 attached.

Figure 8:
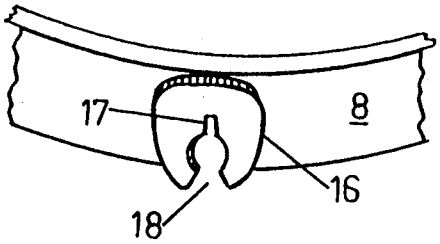
FIG. 8—the end view depicting the shaft clip

The second type of attachment means is of the friction rotation type. This type allows for the counter rotation of the device for implements with shaft rotation. FIG. 8 shows the shaft clip 16. This attachment means engages the shaft of the implement. At the same time, the shaft clip 16 allows for implement 15 rotation as the drag forces are balanced. The shaft clip 16, contains a receiving chamber 18 for the implement 15 shaft and a slot 17 for enhancing the retention pressure. The diameter of the receiving chamber 18 is slightly less than the shaft diameter.

What is claimed is:

1. A training device for attachment to sports swung implements producing air resistance (drag) against the direction of the stroke motion comprising:

a generally rigid body of air impermeable material;

an implement housing recess formed in the body, a peripheral wall of varying height on the body for increasing the resistance of the body as it is swung through the air, and an attachment means for connecting said body to a sports swung implement.

2. The device of claim 1 wherein said body comprises a formed sheet of thin polymer resin.

3. The device of claim 1 also comprising a plurality of ribs formed in said body.

4. The device of claim 3 wherein said ribs join said wall to said housing recess.

5. The device of claim 3 wherein said ribs are angular in nature extending between spaced apart locations from said housing recess to said wall.

6. The device of claim 3 wherein said ribs are level in nature extending from varying points along said wall to the opposing wall.

7. The device of claim 1 comprising in combination, a wall surrounding the periphery of said body and a plurality of ribs formed in said body provide a means to trapping air.

8. The device of claim 1 wherein said housing recess comprises locating means for positioning an implement at a plurality of different positions relative to said body.

9. The device of claim 1 is adapted to receive a variety of sports implements using an attachment means.

10. The device claim 9 wherein said attachment means comprises means for firmly securing an implement to said body.

11. The device of claim 9 wherein said attachment means comprises means for rotatably engaging a shaft of an implement.

12. The device of claim 1 also comprising a means for deflecting air during the backswing portion of a stroke.

13. An exercise device for attaching to sports swung implements for producing air resistance (drag) comprising:

a main body;

a wall of varying height around the circumference of said body for stability;

an implement housing recess adapted for locating a sports swung implement;

a plurality of supporting ribs securing said wall to said body and together with said wall form a means to trap air so as to maximize said drag forces per unit surface area;

and an attachment means for securing a sports implement to the said body.

* * * * *